US006203298B1

(12) United States Patent
Scarfone et al.

(10) Patent No.: US 6,203,298 B1
(45) Date of Patent: Mar. 20, 2001

(54) ENTRAPPED SEPARATOR PLATE FOR SCROLL COMPRESSOR

(75) Inventors: Tommaso F. Scarfone, Bayonne, NJ (US); H. Ezzat Khalifa, Manlius, NY (US); Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/324,132

(22) Filed: Jun. 2, 1999

(51) Int. Cl.[7] ..... F04C 18/04; F04C 27/00
(52) U.S. Cl. ..... 418/55.1; 418/55.4; 418/149
(58) Field of Search ..... 418/55.1, 149, 418/55.4; 417/902

(56) References Cited

U.S. PATENT DOCUMENTS 5,427,511 6/1995 Caillat et al. ..... 418/55.1

FOREIGN PATENT DOCUMENTS 61-40473 * 2/1986 (JP) ..... 418/55.1
63-268995 * 11/1988 (JP) ..... 418/55.1
5-157061 * 6/1993 (JP) ..... 418/55.1
6-93982 * 4/1994 (JP) ..... 418/55.1

* cited by examiner

*Primary Examiner*—John J. Vrablik
(74) *Attorney, Agent, or Firm*—Carlson, Gaskey & Olds

(57) ABSTRACT

A scroll compressor assembly incorporates a separator plate which has a clearance between its outer periphery and an inner periphery of an end cap. In this way, the location of the separator plate along the center axis of the scroll can be adjusted. Further, the separator plate is placed on the center shell prior to attachment of the end cap. Thus, the separator plate need not be welded to the end cap as in the prior art. Problems such as weld splatter thus eliminated.

16 Claims, 2 Drawing Sheets

ENTRAPPED SEPARATOR PLATE FOR SCROLL COMPRESSOR

BACKGROUND OF THE INVENTION

This invention relates to a unique scroll compressor housing assembly wherein the separator plate is captured between an upper end cap and the cylindrical shell.

Compressors for refrigerant compression applications are typically formed with a sealed housing. Usually, the housing encloses a motor and compressor pump unit. The motor is received in a chamber maintained at a low or suction pressure. The housing are formed of a cylindrical center shell and pad caps welded to each end of the shell. Refrigerant to be compressed enters the housing chamber and cools the motor. The refigerant them enters the compressor pump unit and is compressed, and then delivered to a discharge port. From the discharge port, the gas travels into an outlet plenum then to an outlet tube extending through the housing. A separator plate has typically been inserted into the housing above the pump unit to define a separation line between the discharge pressure plenum and the suction pressure chamber.

One type of sealed compressor is a scroll compressor. In a scroll compressor, the compressor pump unit is formed of two scroll members. Each of the scroll members has a base plate with a generally spiral wrap extending from the base plate. One of the two scroll members is driven to orbit relative to the other. The non-orbiting scroll member is typically mounted beneath the separator plate.

In the prior art, scroll compressors are generally provided with a separator plate that is separate from the pump unit. In other types of compressors, the separator plate may be more easily incorporated into the compressor pump unit. However, the non-orbiting scroll is a relatively complex part, and typically a separator plate is utilized. Historically, the separator plate has been welded to the end cap, the center shell, or both.

Typically, the separator plate has been welded to the end cap as a pre-assembly. With this construction, the separator plate carries the discharge port tube. By welding the separator plate, and hence the discharge port tube, to the upper end cap, the location of the tube is difficult to control, and is essentially non-adjustable at final assembly.

Further, weld splatter can get inside top end cap and over the separator plate. If this weld splatter extends into the compressor pump unit, undesirable noise and even failure can occur.

The lack of control over the positioning of the discharge port tube can result in high side loads between various components. This can contribute to misalignment of the scroll members and difficulty in starting the compressor.

The end cap and separator plate pre-assembly is typically pushed over a thin section of the center shell and is subsequently welded. The welding can cause "burn through" of the thin section of the shell and additional weld splatter problems.

SUMMARY OF THE INVENTION

In a disclosed embodiment of this invention, a separator plate is initially associated with the center shell. There is preferably a clearance between the outer periphery of the separator plate and the inner periphery of the end cap. In one embodiment, the separator plate is initially attached to the center shell, and the end cap is then placed over the center shell and welded to the center shell.

In one embodiment, a gasket is placed between the separator plate and the center shell. The separator plate can also be formed with a stepped lip for better positioning.

In another embodiment, a ledge on the end cap captures an upper surface of the separator plate when the end cap is welded to the center shell. In another embodiment, a seal pocket is formed in the upper surface of the separator plate, and a seal material is placed in the pocket.

Generally, the end cap abuts an upper surface of the separator plate. The separator plate is free to move relative to the end cap to compress the seal material.

The high pressure above the separator plate creates a force pressing downwardly on the separator plate to ensure a good seal at the interface between the separator plate and an upper end of the center shell. Thus, leakage is unlikely to occur even though the separator plate is not welded to the center shell or the end cap, as in the prior art.

The present invention also allows adjustment of the separator plate, and thus the location of the discharge port tube, to ensure ease of positioning of the several components at assembly.

These and other features of the present invention can be best understood from the following specifications and drawings, the following of which is a brief description.

PREFERRED EMBODIMENT OF THE PRESENT INVENTION

Figure 1A:
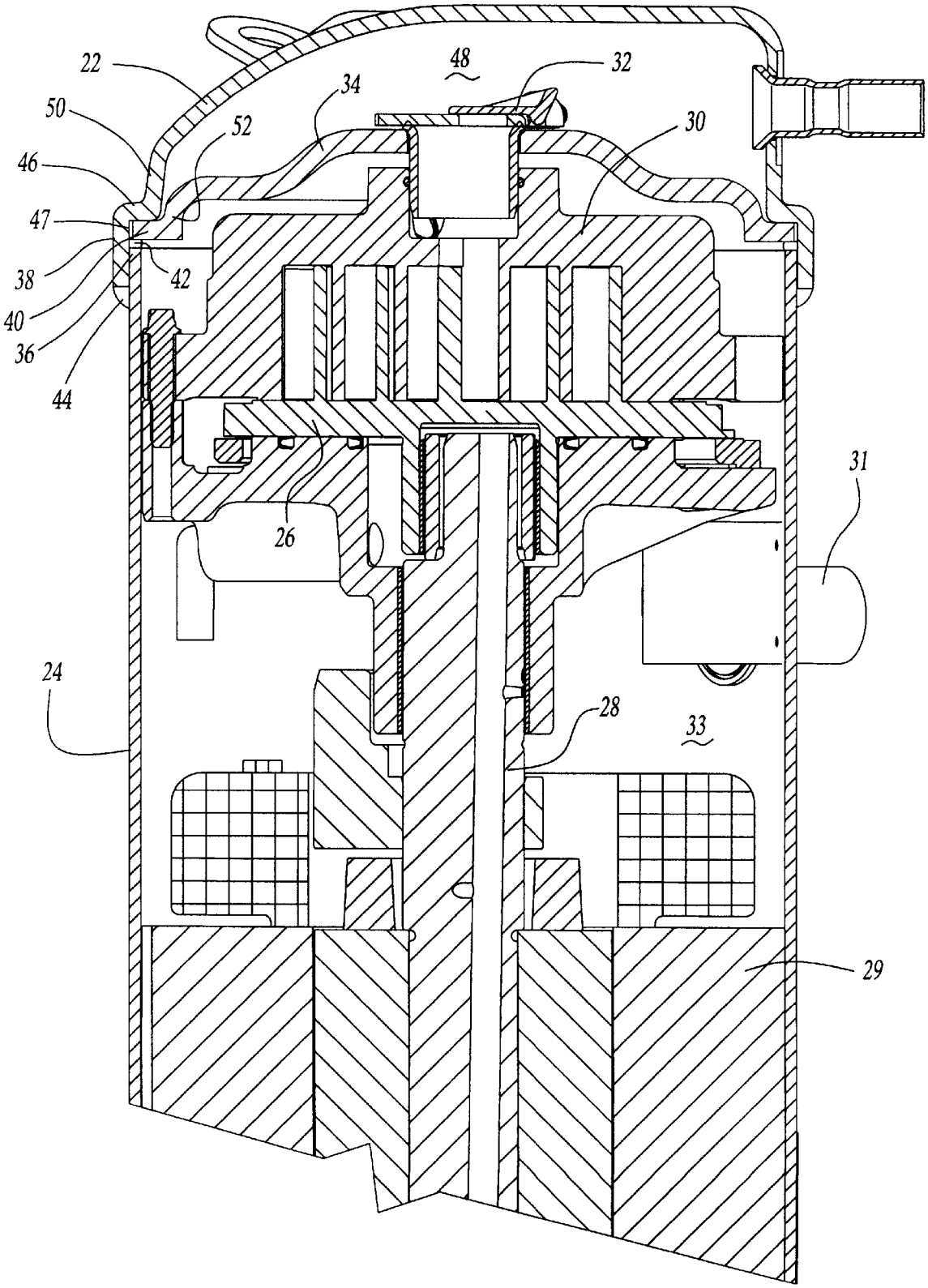
FIG. 1A is a cross-sectional view through a first embodiment of the present invention.

FIG. 1A shows a scroll compressor 20 incorporating an upper end cap 22 and a center shell 24, as known. An orbiting scroll member 26 is driven by a shaft 28 associated with an electric motor 29. A non-orbiting scroll 30 interfits with the orbiting scroll 26 to define a compressor pump unit. An inlet tube 31 allows refrigerant to enter into a chamber 33 surrounding the motor, and pass into the pump unit. A discharge tube 32 extends through the non-orbiting scroll 30, and is received in a separator plate 34.

The center shell 24 has an upper end 36 received radially inwardly of a lower edged end 38 of the upper end cap 22. A outwardly turned flange 40 on the separator plate 34 is positioned above a gasket seal or sealant 42. Various types of seals can be used. There is a connection between the upper edge 36 of the center shell and separator plate flange 40 at the gasket or sealant 42. Notably, the sealant 42 need not provide structural securement for the plate 34, but merely defines a seal area. Thus, the separator plate 34 is moveable relative to edge 36.

A weld joint 44 is formed between a lower end of the portion 38 and the upper shell 24 to secure the end cap 22 on the center shell 24. Preferably, the upper end cap 22 is welded to the center shell 24 after the separator plate 34 has been positioned on the center shell 24. In this way, the position of the separator plate 34, and the tube 32, can be adjusted to conform to a desired position for the remainder of the components of the compressor unit, and in particular the non-orbiting scroll 30.

An outwardly turned flange portion 46 of the upper end cap 22 abuts an upper end of the flange 40 to position the separator plate 34 on the gasket material 42. Preferably, portion 46 is not fixed to flange 40. Notably, there is preferably a clearance 47 radially outwardly of the flange 40, and between an inner peripheral portion of the lower portion 38 of the end cap 22. Portion 50 of the end cap extends axially downwardly generally parallel to a portion 52 of the separator plate.

In operation, a chamber 48 above the separator plate 34 will be at discharge pressure. Thus, a high pressure force is pressing downwardly on the separator plate 34 during operation of the scroll compressor. Since separator plate 34 is free to move axially against the seal, this high force will ensure the portion 40 is forced against the seal 42 and will prevent leakage of compressed refrigerant from the chamber 48 into the suction pressure chamber 33.

At the same time, since the separator plate 34 is not welded to any housing component, weld splatter within the interior of the compressor components is eliminated. Moreover, the relative radial position of the separator plate and a discharge tube 32 can be easily adjusted as desired due to the clearance 47. To achieve the clearance 47, it should be understood that the outer diameter of the portion 40 is designed to be somewhat smaller than the inner diameter of the portion 38. A large clearance need not be provided; however, it is desirable to have sufficient clearance such that the separator plate can be adjusted radially about the center axis of the shell 24, while still allowing attachment of the upper end cap 22 at a later point.

In summary, it should be understood that the separator plate 34 is initially preferably placed on center shell 24, and that the upper end cap 22 is then attached to the center shell 24.

Figure 1B:
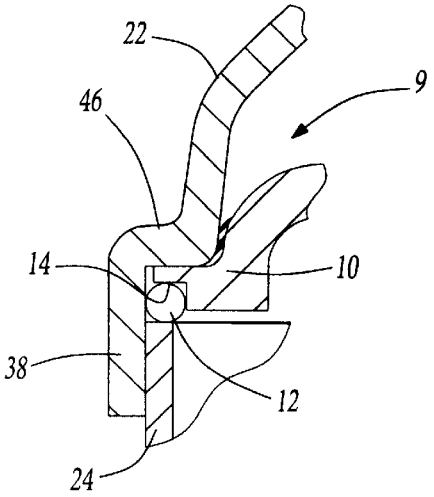
FIG. 1B shows another embodiment.

As shown in FIG. 1B, in a second embodiment 9, the separator plate 10 is formed with a seal pocket 12 at an outer periphery at the flange. The end cap 38 is again brought downwardly and welded to the center shell 24. The separator plate 10 remains unsecured to the end cap, and is moveable both radially and axially relative to both the end cap and the center shell. Thus, the sealing provided by the compressed seal 14 will be achieved with this embodiment. Further, the use of the seal pocket 12 helps position the seal 14 at a predictable location.

Figure 2A:
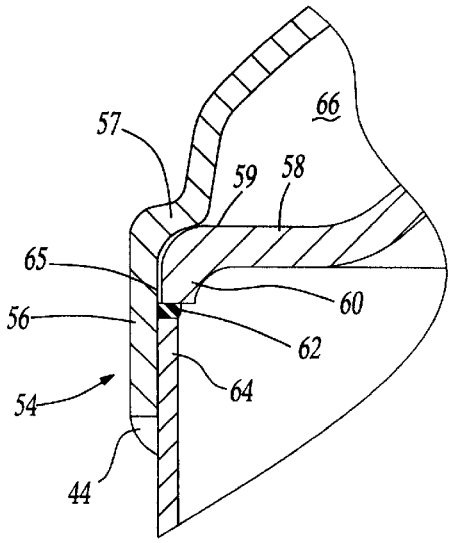
FIG. 2A is an enlarged portion of another embodiment of the present invention.

FIG. 2A shows a subsequent embodiment 54 wherein the upper end cap 56 has a flange 57 abutting an upper edge 59 of separator plate 58. Separator plate 58 has a downwardly turned rim 60 held against a seal or gasket 62 on the center shell 64. Again, there is a clearance 65 between the outer diameter of the separator plate 58 and the inner diameter of the end cap 56. A weld joint 44 again secures the upper end cap 56 to the center shell 64. Discharge pressure in discharge chamber 66 ensures the separator plate 58 is biased against the seal 62 to provide an adequate seal.

Figure 2B:
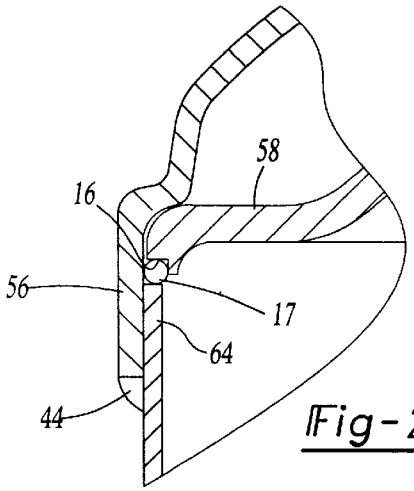
FIG. 2B shows another embodiment.

As shown in FIG. 2B, a seal pocket 16 and seal 17 similar to the FIG. 1B embodiment may also be used with a structure similar to the FIG. 2A embodiment. Again, the seal pocket 16 provides adequate and predictable positioning for the seal 17.

Figure 3:
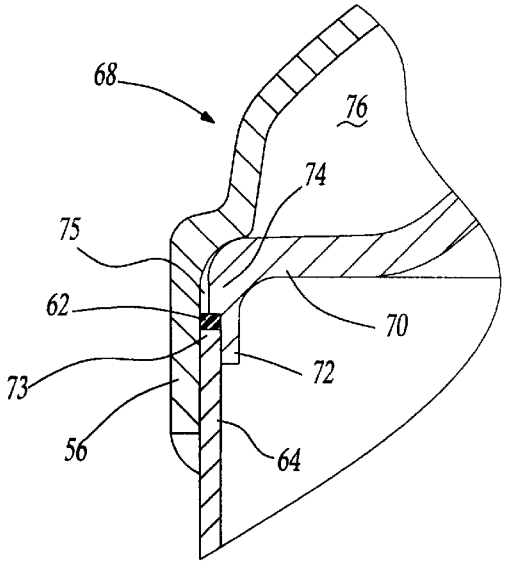
FIG. 3 is an enlarged portion of another embodiment.

FIG. 3 shows another embodiment 68, wherein the end cap 56 is again secured to the center shell 64. However, the separator plate 70 has a lower lip 72 extending downwardly beyond the upper end 73 of the center shell 64 from an upper portion 74. There is still a clearance 75 radially inwardly of the upper end cap 56. The lip 72 ensures that the separator plate will be properly positioned on the center shell 64 to achieve a good seal on the seal or gasket material 62. Again, pressure in the chamber 76 will bias the separator plate 70 against the seal 62. It should be understood that the outer diameter of the portion 72 will be preferably slightly smaller than the inner diameter of the center shell 64, again to allow adjustment of the separator plate 70.

Figure 4:
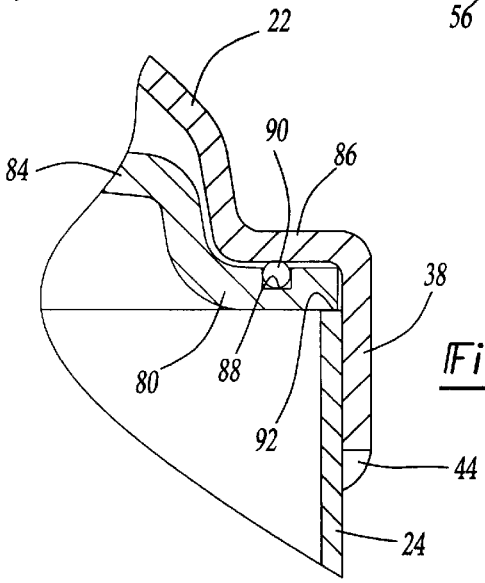
FIG. 4 shows another embodiment.

Another embodiment is illustrated in FIG. 4. In the FIG. 4 embodiment, the separator plate 84 has a flange 80 extending outwardly. The end cap 22 has its flange 86 abutting the upper surface of the separator plate flange 80. An upper end 92 of the center shell 24 is also abutted by the flange 80. Again, there is a clearance between the outer periphery of the flange 80 and the inner periphery of the end cap 22. A seal pocket 88 is formed in the upper surface of the separator plate 80 and a seal 90 is placed in the seal pocket. When the end cap 22 is welded at 44 to the center shell 24, the seal 90 is compressed. Again, during operation, discharge pressure above the separator plate can force the separator plate 80 downwardly against an upper end 92 of center shell 24. A seal may be placed between the upper end 92 and the separator plate 80 to provide an even better seal. However, the seal 90 will expand during any of this movement and still ensure an adequate seal is provided.

Throughout this application, the word "seal" should be taken to be any seal or seal material which would provide an adequate seal against the refrigerant in the disclosed compressors. An o-ring may be utilized in several of the embodiments having a seal pocket, however, any other type seal may also be utilized.

In general, the embodiments in this application have an end cap with a surface abutting an upper surface of the separator plate. The end cap is welded to the center shell. The separator plate is preferably not welded or fixably attached to either the end cap or the center shell. Rather, the separator plate can be adjusted radially during assembly relative to both the center shell and the end cap. Further, during operation, the separator plate may move axially relative to both the end cap and the center shell to compress a seal and provide an adequate seal between the discharge pressure chamber and the suction pressure chamber.

Moreover, while the invention has been disclosed as a scroll compressor, and while there are particular benefits associated with the use of this invention in the scroll compressor, the invention may have application in other types of compressors.

Preferred embodiments of the present invention have been disclosed; however, a worker in this art would recognize that certain modifications would come within the scope of this invention. For that reason, the following claims should be studied to determine the true scope and content of this invention.

What is claimed is:

1. A compressor comprising:

a center shell defining an interior volume;

a motor received in said interior volume, said motor driving a shaft;

a compressor pump unit driven by said shaft, said compressor pump unit being received within said interior volume;

a suction supply for supplying a suction pressure refrigerant into said interior volume;

a discharge port extending from said compressor pump unit, said communicating compressed gas from said compressor pump unit into a discharge pressure chamber;

an end cap welded to said center shell; and a separator plate positioned at an end of said center shell, and defining a separation between said discharge pressure chamber and said interior volume, there being a clearance between an outer peripheral surface of said separator plate and an inner peripheral surface of said end cap so that said outer peripheral surface of said separator plate can be adjusted toward said inner peripheral surface of said end cap within said clearance.

2. A compressor as recited in claim 1, wherein said compressor pump unit is a scroll compressor pump unit.

3. A compressor as recited in claim 1, wherein said end cap has a flange portion contacting an upper face of said separator plate, with said clearance being defined outwardly of a radially outermost peripheral edge of said separator plate.

4. A compressor as recited in claim 1, wherein said end cap is welded to an outer peripheral surface of said center shell, and said separator plate is not fixed to said end cap.

5. A compressor as recited in claim 1, wherein a seal is positioned between said separator plate and said center shell, and said separator plate being moveable relative to said center shell.

6. A compressor as recited in claim 5, wherein said end cap is moveable along a rotation axis of said shaft relative to said end cap and said center shell and against said seal.

7. A compressor as recited in claim 1, wherein a seal is positioned between said end cap and said separator plate.

8. A compressor as recited in claim 7, wherein said end cap is moveable along a rotation axis of said shaft relative to said end cap and said center shell and against said seal.

9. A compressor as recited in claim 8, wherein said seal is placed in a pocket in an upper face of said separator plate, and said end cap having a portion in contact with said seal.

10. A compressor as recited in claim 1, wherein said separator plate has an axial extending lip extending radially inwardly of an edge of said center shell.

11. A compressor comprising:

a center shell defining an interior volume;

a motor received in said interior volume, said motor driving a shaft;

a compressor pump unit driven by said shaft, said compressor pump unit being received within said interior volume;

a suction supply for supplying a suction pressure refigerant into said interior volume;

a discharge port extending from said compressor pump unit, said communicating compressed gas from said compressor pump unit into a discharge pressure chamber;

an end cap welded to said center shell;

a separator plate positioned at an end of said center shell, and defining a separation between said discharge pressure chamber and said interior volume, there being a clearance between an outer peripheral surface of said separator plate and an inner peripheral surface of said end cap; and discharge pressure gas in said discharge pressure chamber biases said separator plate downwardly against said center shell.

12. A scroll compressor comprising:

a first scroll member comprising a base and a generally spiral wrap extending from said base;

a second scroll member including a base and a generally spiral wrap extending from said base;

a shaft driven by an electric motor, said shaft driving said second scroll member to orbit relative to said first scroll member;

a center shell surrounding said motor and said compressor pump unit;

a suction tube for delivering a refrigerant to be compressed into said center shell, said motor and said compressor pump unit being received in an interior chamber within said shell which is at suction pressure;

an end cap welded to said center shell;

a discharge port extending through said first scroll member, and into a discharge pressure chamber; and a separator plate mounted above said first scroll member to separate said discharge pressure chamber from said interior chamber, said separator plate being held against an upper end of said center shell, but having a clearance between an outer peripheral surface and an inner peripheral surface of said end cap.

13. A scroll compressor as recited in claim 12, wherein said separator plate is held against an upper end of said center shell, and a seal is placed between the two such that said separator plate may move toward said center shell.

14. A scroll compressor as recited in claim 12, wherein said separator plate has a flange extending radially outwardly, and a seal pocket is formed in said flange, a seal received in said flange and a surface of said end cap abutting said seal.

15. A scroll compressor as recited in claim 12, wherein said separator plate is moveable along an axis of rotation of said shaft relative to both said end cap and said center shell.

16. A scroll compressor comprising:

a center shell defining an interior volume;

a motor received in said interior volume, said motor driving a shaft;

a compressor pump unit driven by said shaft, said compressor pump unit being received within said interior volume;

a suction supply for supplying a suction pressure refrigerant into said interior volume;

a discharge port extending from said compressor pump unit, said communicating compressed gas from said compressor pump unit into a discharge pressure chamber;

an end cap welded to said center shell;

a separator plate positioned at an end of said center shell, and defining a separation between said discharge pressure chamber and said interior volume, there being a clearance between an outer peripheral surface of said separator plate and an inner peripheral surface of said end cap; and said separator plate defines a discharge pressure plate on an opposed face from a face facing said compressor pump unit, said discharge pressure chamber being positioned between said separator plate and said end cap, and said interior volume being defined on a face of said separator plate facing said compressor pump unit.

* * * * *